US010874218B2

(12) United States Patent
Chen et al.

(10) Patent No.: US 10,874,218 B2
(45) Date of Patent: Dec. 29, 2020

(54) FOLDING ROCKING CHAIR AND FOLDING MECHANISM THEREOF

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 0 days.

(21) Appl. No.: 16/735,634

(22) Filed: Jan. 6, 2020

(65) Prior Publication Data

US 2020/0305606 A1 Oct. 1, 2020

(30) Foreign Application Priority Data

Mar. 28, 2019 (CN) ..... 2019 2 0414255 U

(51) Int. Cl.
*A47C 3/029* (2006.01)
*A47C 4/28* (2006.01)

(52) U.S. Cl.
CPC ..... *A47C 3/029* (2013.01); *A47C 4/286* (2013.01)

(58) Field of Classification Search
CPC ..... A47C 3/029; A47C 4/286
See application file for complete search history.

(56) References Cited

U.S. PATENT DOCUMENTS

| | | | | |
|---|---|---|---|---|
| 3,114,572 | A * | 12/1963 | Hopkins | A47C 3/029 297/33 |
| 6,439,656 | B1 * | 8/2002 | Liu | A47C 3/029 297/271.6 |
| 7,100,975 | B1 * | 9/2006 | Zheng | A47C 3/029 297/271.6 |
| 10,213,023 | B2 * | 2/2019 | Yang | A47C 3/029 |
| 10,368,644 | B1 * | 8/2019 | Haingaertner | A47C 3/029 |

* cited by examiner

*Primary Examiner* — Anthony D Barfield
(74) *Attorney, Agent, or Firm* — Bayramoglu Law Offices LLC

(57) ABSTRACT

A folding mechanism includes a rocking bar, wherein the rocking bar includes an arc-shaped portion that is in contact with the ground; a first supporting bar, wherein a portion of the first supporting bar near the first end portion thereof is pivotally connected to the first connecting member through the first pivotal shaft. The first connecting member is connected to the rocking bar and can slide along the rocking bar. A second connecting member is directly connected to a portion of the first supporting bar near the second end portion thereof. A folding rocking chair includes two groups of folding mechanisms, a front cross mechanism and a rear cross mechanism. The two groups of the folding mechanisms are symmetrical about a center plane.

19 Claims, 6 Drawing Sheets

FOLDING ROCKING CHAIR AND FOLDING MECHANISM THEREOF

CROSS REFERENCE TO THE RELATED APPLICATIONS

This application is based upon and claims priority to Chinese Patent Application No. 201920414255.0, filed on Mar. 28, 2019, the entire contents of which are incorporated herein by reference.

TECHNICAL FIELD

The present disclosure relates to folding chairs and more specifically relates to a folding rocking chair having a folding mechanism.

BACKGROUND

Folding chairs are widely used in both indoor and outdoor settings. They are convenient to transport, store and use. Demand for comfortable folding chairs are increasing, because of that demand, folding rocking chairs have been used in this field.

The structural design of a folding rocking chairs is more complex than the regular folding chairs. The existing folding rocking chairs can realize the functions of folding and rocking, but these folding rocking chairs have problems while in folded state, such as compactness and demand of a relatively large space for storage.

SUMMARY

The technical problem to be solved in the present invention are as follows: the folding chairs of the prior art has the problems of relatively poor compactness in the folded state and occupying more space as described in the prior arts. The present disclosure provides a folding rocking chair and a folding mechanism to solve the above problems.

The technical solution employed in the present disclosure, in order to solve the technical problems, is as follows: a folding mechanism includes:

a rocking bar, wherein the rocking bar includes an arc-shaped ground-contacting portion;

a first supporting bar, wherein a portion of the first supporting bar near the first end portion thereof is pivotally connected to a first connecting member through the first pivot shaft, the first connecting member is connected to the rocking bar and is configured to slide along the rocking bar, and a second connecting member is fixedly connected to the portion of the first supporting bar near the second end portion thereof;

a first main bar, wherein the first main bar includes the first bending section and the second bending section that are bent relative to each other, the third connecting member is fixedly connected to a portion of the first bending section near the first end portion thereof, the third connecting member is pivotally connected to a portion of the rocking bar near the first end portion thereof through the third pivot shaft, the first connecting member is located between the second end portion of the rocking bar and the third connecting member, and a portion of the first bending section near the second end portion thereof is pivotally connected to the second connecting member through the second pivot shaft;

a second supporting bar, wherein a portion of the second supporting bar near the first end portion thereof is pivotally connected to the fourth connecting member through the fourth pivot shaft, the fourth connecting member is connected to the first bending section and is configured to slide along the first bending section, and the fourth connecting member is located between the second connecting member and the third connecting member; and a third supporting bar, wherein a portion of the third supporting bar near a first end portion thereof is pivotally connected to a portion of the second support bar near the second end portion thereof through the fifth pivot shaft, a portion of the third supporting bar near the second end portion thereof is pivotally connected to the sixth connecting member through the sixth pivot shaft, the sixth connecting member is connected to the first supporting bar and is configured to slide along the first supporting bar, the sixth connecting member is located between the first connecting member and the second connecting member, the first bending section is pivotally connected to the third supporting bar through the ninth pivot shaft, the ninth pivot shaft on the first bending section is located between the second connecting member and the fourth connecting member, the ninth pivot shaft on the third supporting bar is located between the fifth pivot shaft and the sixth connecting member; the first pivot shaft, the second pivot shaft, the third pivot shaft, the fourth pivot shaft, the fifth pivot shaft, the sixth pivot shaft, and the ninth pivot shaft are parallel to each other.

Preferably, the folding rocking chair mechanism further includes an armrest, wherein the seventh connecting member is fixed to a portion of the armrest near the first end portion thereof, and a portion of the second supporting bar near the second end portion thereof is pivotally connected to the seventh connecting member through the seventh pivot shaft. A portion of the first bending section near the second end portion thereof is pivotally connected to the eighth connecting member through an eighth pivot shaft, and the eighth connecting member is connected to the armrest and is configured to slide along the armrest. The seventh pivot shaft, the eighth pivot shaft, and the first pivot shaft are parallel to each other.

Preferably, the armrest is provided with a sliding groove, the eighth connecting member includes a slider, and the slider is matched with the sliding groove in a sliding manner.

Preferably, the ground-contacting portion has an arc surface formed by a plurality of continuous straight lines parallel to each other along the length direction of the rocking bar.

Preferably, the first connecting member includes a first sliding sleeve, the first sliding sleeve is provided on the rocking bar in a sliding manner, the fourth connecting member includes a second sliding sleeve, and the second sliding sleeve is provided on the first bending section in a sliding manner.

Preferably, the second connecting member includes a first limiting portion having a first limiting notch, and the second pivot shaft penetrates through two side walls of the first limiting notch and the first bending section. When the folding mechanism is unfolded, the first bending section is embedded in the first limiting notch and is supported by the bottom of the first limiting notch.

Preferably, the third connecting member includes a second limiting portion having a second limiting notch, and the third pivot shaft penetrates through two side walls of the second limiting notch, and the rocking bar. When the folding mechanism is unfolded, the rocking bar is embedded in the second limiting notch and is pushed by the bottom of the second limiting notch.

A folding rocking chair includes two groups of folding mechanisms, and the two groups of the folding mechanisms are symmetrical about the center plane.

The folding rocking chair includes a front cross mechanism and a rear cross mechanism.

The front cross mechanism includes a first front crossbar and a second front crossbar that cross and are pivotally connected by a tenth pivot shaft at the intersection. A portion of the first front crossbar, near a first end portion thereof, is pivotally connected to a first angle iron through an eleventh pivot shaft. A portion of the second front crossbar, near the first end portion thereof, is pivotally connected to the second angle iron through the twelfth pivot shaft. The first angle iron is pivotally connected to the third supporting bar of one group of the folding mechanisms through the thirteenth pivot shaft. The second angle iron is pivotally connected to the third supporting bar of the other group of the folding mechanisms through the fourteenth pivot shaft. The thirteenth and fourteenth pivot shafts are respectively located near two fifth pivot shafts, or the thirteenth and fourteenth pivot shafts are the same pivot shafts as the two fifth pivot shafts. The thirteenth pivot shaft and the fourteenth pivot shaft are symmetrical about the center plane.

A portion of the first front crossbar near the second end portion thereof is pivotally connected to the third angle iron through the fifteenth pivot shaft. A portion of the second front crossbar near the second end portion thereof is pivotally connected to the fourth angle iron through the sixteenth pivot shaft. The third angle iron is pivotally connected to the third connecting member of one group of the folding mechanisms through the seventeenth pivot shaft. The fourth angle iron is pivotally connected to the third connecting member of the other group of the folding mechanisms through the eighteenth pivot shaft. The seventeenth pivot shaft and the eighteenth pivot shaft are symmetrical about the center plane.

The tenth pivot shaft is located in the center plane, and the eleventh pivot shaft, the twelfth pivot shaft, the fifteenth pivot shaft, and the sixteenth pivot shaft are all parallel to the tenth pivot shaft.

The rear cross mechanism includes the first rear crossbar and the second rear crossbar that cross that are pivotally connected by the nineteenth pivot shaft at the intersection. A portion of the first rear crossbar near the first end portion thereof is pivotally connected to the fifth angle iron through a twentieth pivot shaft. A portion of the second rear crossbar near the first end portion thereof is pivotally connected to the sixth angle iron through the twenty-first pivot shaft. The fifth angle iron is pivotally connected to the second bending section of one group of the folding mechanisms through the twenty-second pivot shaft. The sixth angle iron is pivotally connected to the second bending section of the other group of the folding mechanisms through the twenty-third pivot shaft. The twenty-second pivot shaft and the twenty-third pivot shaft are symmetrical about the center plane.

A portion of the first rear crossbar near a second end portion thereof is pivotally connected to a seventh angle iron through a twenty-fourth pivot shaft. A portion of the second rear crossbar, near a second end portion thereof, is pivotally connected to an eighth angle iron through a twenty-fifth pivot shaft. The seventh angle iron is pivotally connected to the sixth connecting member of one group of the folding mechanisms through a twenty-sixth pivot shaft. The eighth angle iron is pivotally connected to the sixth connecting member of the other group of the folding mechanisms through a twenty-seventh pivot shaft. The twenty-sixth pivot shaft and the twenty-seventh pivot shaft are symmetrical about the center plane.

The nineteenth pivot shaft is located in the center plane. The twentieth pivot shaft, the twenty-first pivot shaft, the twenty-fourth pivot shaft, and the twenty-fifth pivot shaft are all parallel to the nineteenth pivot shaft.

Preferably, the twenty-sixth pivot shaft is the sixth pivot shaft of one group of the folding mechanisms, and the twenty-seventh pivot shaft is the sixth pivot shaft of the other group of the folding mechanisms.

The folding mechanism further includes a fifth connecting member. The fifth connecting member is sleeved on the third supporting bar. The fifth pivot shaft penetrates through the second supporting bar, the third supporting bar, and the fifth connecting member. The first angle iron is pivotally connected to the fifth connecting member of one group of the folding mechanisms through the thirteenth pivot shaft. The second angle iron is pivotally connected to the fifth connecting member of the other group of the folding mechanisms through the fourteenth pivot shaft.

A folding rocking chair includes two groups of folding mechanisms, and the two groups of the folding mechanisms are symmetrical about a center plane.

The folding rocking chair includes the front cross mechanism and the rear cross mechanism.

The front cross mechanism includes the first front crossbar and the second front crossbar that cross and are pivotally connected by the tenth pivot shaft at the intersection. A portion of the first front crossbar, near the first end portion thereof, is pivotally connected to the first angle iron through the eleventh pivot shaft. A portion of the second front crossbar, near the first end portion thereof, is pivotally connected to the second angle iron through the twelfth pivot shaft. The first angle iron is pivotally connected to the third supporting bar of one group of the folding mechanisms through the thirteenth pivot shaft. The second angle iron is pivotally connected to the third supporting bar of the other group of the folding mechanisms through a fourteenth pivot shaft. The thirteenth and fourteenth pivot shafts are respectively located near two fifth pivot shafts. The thirteenth and fourteenth pivot shafts are the same pivot shafts as the two fifth pivot shafts. The thirteenth pivot shaft and the fourteenth pivot shaft are symmetrical about the center plane.

A portion of the first front crossbar, near the second end portion thereof, is pivotally connected to the third angle iron through the fifteenth pivot shaft. A portion of the second front crossbar, near the second end portion thereof, is pivotally connected to the fourth angle iron through the sixteenth pivot shaft. The third angle iron is pivotally connected to the third connecting member of one group of the folding mechanisms through the seventeenth pivot shaft. The fourth angle iron is pivotally connected to the third connecting member of the other group of the folding mechanisms through the eighteenth pivot shaft. The seventeenth pivot shaft and the eighteenth pivot shaft are symmetrical about the center plane.

The tenth pivot shaft is located in the center plane, and the eleventh pivot shaft, the twelfth pivot shaft, the fifteenth pivot shaft, and the sixteenth pivot shaft are all parallel to the tenth pivot shaft.

The rear cross mechanism includes the first rear crossbar and the second rear crossbar that cross and are pivotally connected by the nineteenth pivot shaft at the intersection. A portion of the first rear crossbar near a first end portion thereof is pivotally connected to a fifth angle iron through a twentieth pivot shaft. A portion of the second rear crossbar, near the first end portion thereof, is pivotally connected to the sixth angle iron through the twenty-first pivot shaft. The fifth angle iron is pivotally connected to the second bending section of one group of the folding mechanisms through a twenty-second pivot shaft. The sixth angle iron is pivotally connected to the second bending section of the other group of the folding mechanisms through a twenty-third pivot shaft. The twenty-second pivot shaft and the twenty-third pivot shaft are symmetrical about the center plane.

A portion of the first rear crossbar near the second end portion thereof is pivotally connected to the seventh angle iron through the twenty-fourth pivot shaft. A portion of the second rear crossbar, near the second end portion thereof, is pivotally connected to the eighth angle iron through the twenty-fifth pivot shaft. The seventh angle iron is pivotally connected to the first connecting member of one group of the folding mechanisms through the twenty-sixth pivot shaft. The eighth angle iron is pivotally connected to the first connecting member of the other group of the folding mechanisms through the twenty-seventh pivot shaft. The twenty-sixth pivot shaft and the twenty-seventh pivot shaft are symmetrical about the center plane.

The nineteenth pivot shaft is located in the center plane. The twentieth pivot shaft, the twenty-first pivot shaft, the twenty-fourth pivot shaft, and the twenty-fifth pivot shaft are all parallel to the nineteenth pivot shaft.

Preferably, the twenty-sixth pivot shaft is the first pivot shaft of one group of the folding mechanisms, and the twenty-seventh pivot shaft is the first pivot shaft of the other group of the folding mechanisms.

The folding mechanism further includes the fifth connecting member. The fifth connecting member is sleeved on the third supporting bar. The fifth pivot shaft penetrates through the second supporting bar, the third supporting bar, and the fifth connecting member. The first angle iron is pivotally connected to the fifth connecting member of one group of the folding mechanisms through the thirteenth pivot shaft. The second angle iron is pivotally connected to the fifth connecting member of the other group of the folding mechanisms through the fourteenth pivot shaft.

The advantages of the present disclosure are that the folding rocking chair has a compact structure in a folded state, takes up less space, and is convenient to carry and store.

BRIEF DESCRIPTION OF THE DRAWINGS

The present disclosure is further described in the drawings and the embodiments below.

Figure 1:
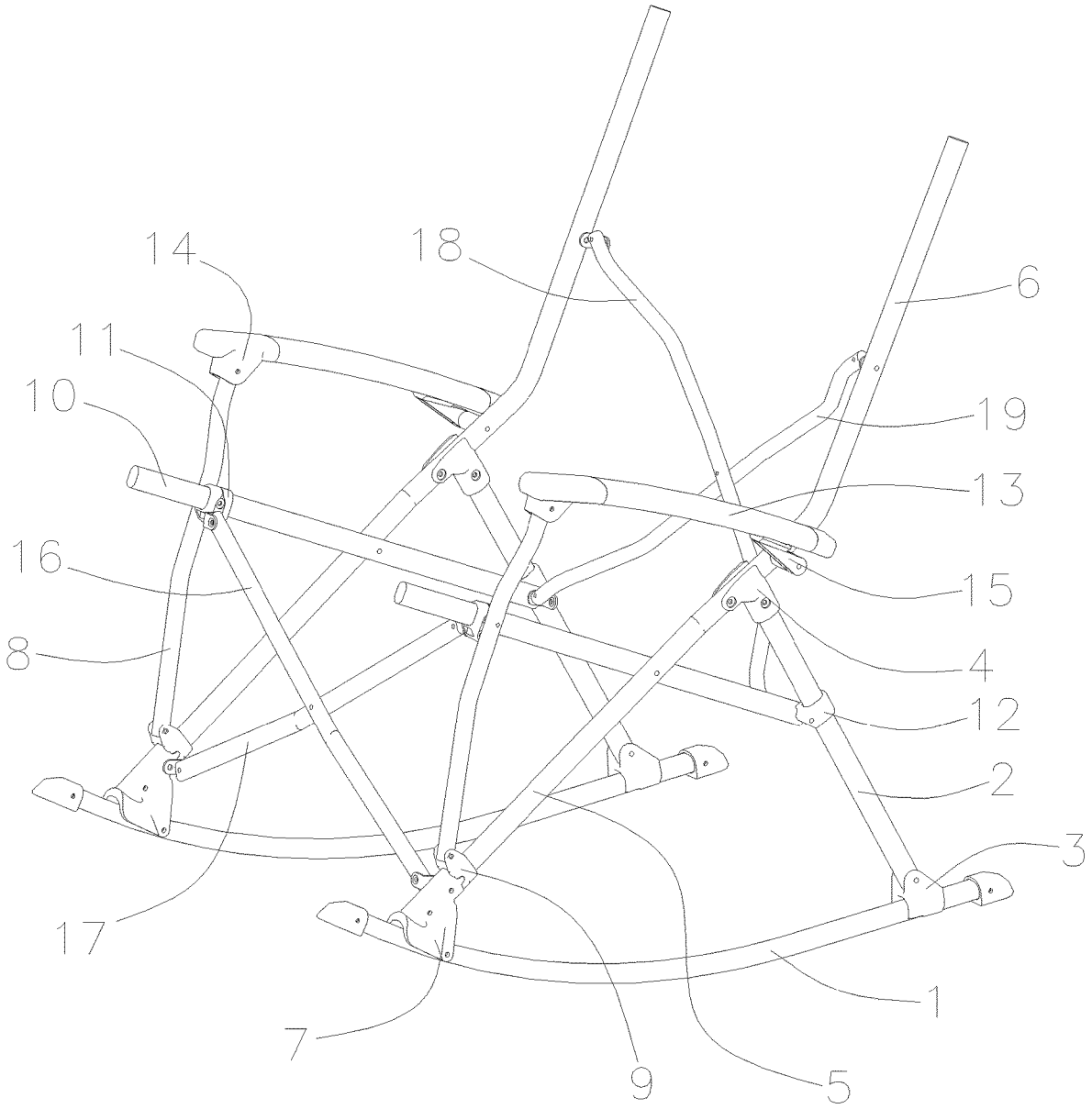
FIG. 1 is a structural schematic diagram of a folding rocking chair in an unfolded state according to embodiment 1 of the present disclosure.

In the figures, 1—rocking bar, 2—first supporting bar, 3—first connecting member, 4—second connecting member, 5—first bending section, 6—second bending section, 7—third connecting member, 8—second supporting bar, 9—fourth connecting member, 10—third supporting bar, 11—fifth connecting member, 12—sixth connecting member, 13—armrest, 14—seventh connecting member, 15—eighth connecting member, 16—first front crossbar, 17—second front crossbar, 18—first rear crossbar, 19—second rear crossbar, 20—first handle, and 21—second handle.

DETAILED DESCRIPTION OF THE EMBODIMENTS

Embodiments of the present disclosure are described in detail below. Illustrations of the embodiments are shown in the drawings, wherein the same or similar reference numerals indicate the same or similar elements or elements having the same or similar functions throughout. The embodiments described below regarding the drawings are exemplary and are only used to explain the present disclosure, but should not be construed as limiting the present disclosure.

In the description of the present disclosure, it should be understood that the orientation or position relationship indicated by the terms "center", "longitudinal", "transverse", "length", "width", "thickness", "upper", "lower", "front", "rear", "left", "right", "vertical", "horizontal", "top", "bottom", "inside", "outside", "axial", "radial", "circumferential", or other terms, is based on the orientation or position relationship shown in the drawings. These are only used to facilitate describing the present disclosure, simplifying the description, and are not intended to indicate or imply that the device or element referred to should have a specific orientation or be constructed and operate in a specific orientation, and therefore cannot be understood as a limitation to the present disclosure.

Also, the terms "first", "second", and the like, are merely used for descriptive purposes and should not be interpreted as indicating or implying relative importance. In the description of the present disclosure, it should be noted that the terms "interconnected" and "connected" should be understood in a broad sense unless otherwise specified and limited. For example, the above quoted terms may be fixed connections, detachable connections, or integrally connected. Also, the above quoted terms may be mechanical connections or electrical connections, or may be direct connections or indirect connections through an intermediate medium. For those of ordinary skill in the art, the specific meanings of the above terms in the present disclosure may be understood in a specific situation. Furthermore, in the description of the present disclosure, unless otherwise stated, the meaning of "plurality" is two or more.

As shown in FIG. 1, a folding rocking chair that can be laid flat on the ground after being unfolded in embodiment 1 includes two groups of folding mechanisms. The two groups of the folding mechanisms are symmetrical about a center plane. Each of the folding mechanisms includes:

the rocking bar 1, wherein the rocking bar 1 includes a ground-contacting portion; the ground-contacting portion is the portion that touches the ground when the rocking chair rocks, so the ground-contacting portion is arc-shaped in the length direction of the rocking bar 1; other portions of the rocking bar 1 are not limited to a certain shape on the premise of not hindering the rocking of the rocking chair, nor affecting the compactness after being folded; in this embodiment, the rocking bar 1 has an arc shape as a whole, and the bottom surface of the rocking bar is the ground contact portion; the ground-contacting portion is an arc surface formed by a plurality of straight lines parallel to each other along the length direction of the rocking bar; when the rocking chair is unfolded and placed on the ground statically, the ground-contacting portion is in linear contact with the ground; when the rocking chair is rocked, the entire surface of the ground-contacting portion can be in contact with the ground, thereby improving the stability of the rocking chair during rocking, and avoiding side to side shaking. Both ends of the rocking bar 1 are sealed by plastic parts;

the first supporting bar 2, wherein a portion of the first supporting bar 2 near the first end portion thereof is pivotally connected to the first connecting member 3 through the first pivot shaft; the first connecting member 3 includes the first sliding sleeve, and the first sliding sleeve is sleeved on the rocking bar 1 in a sliding manner; the second supporting member 4 is fixedly connected to a portion of the first supporting bar 2 near the second end portion thereof; the "first and second portion ends" mentioned herein and hereinafter refer to the edges of both ends of the bar; the "near a first end portion" means that the portion has the relatively short distance from the first end portion of the bar and can be connected to other components; the specific distance can be determined by persons skilled in the art according to their general knowledge; so called the "near a second end" and the same description below; when the rocking chair is unfolded, the first end portion of the first supporting bar 2 is closer to the second end portion of the rocking bar 1, and the second end portion of the first supporting bar 2 is inclined toward the front side direction (hereinafter referred to as the front side) of the chair;

the first main bar, wherein the first main bar includes the first bending section 5 and the second bending section 6 that are bent relative to each other, and the bending angle is obtuse; a portion of the first bending section 5 near the second end portion thereof is pivotally connected to the second connecting member 4 through the second pivot shaft; the second connecting member 4 is L-shaped and includes the sleeve with an integrated structure and the first limiting portion having the first limiting notch; the second end portion of the first supporting bar 2 is inserted into the sleeve and fixed by a pin; the second pivot shaft penetrates through the two side walls of the first limiting notch of the first limiting portion and the first bending section 5; when the chair is unfolded, the first bending section 5 is embedded in the first limiting notch and is supported by the bottom of the first limiting notch, which limits the further unfolding of the rocking chair;

the first connecting member 3, wherein the first connecting member 3 is located between the second end portion of the rocking bar 1 and the third connecting member 7; the third connecting member 7 includes the sleeve and the second limiting portion having the second limiting notch; the portion of the first bending section 5 near the first end portion thereof is inserted into the sleeve and fixed by a pin; the third pivot shaft penetrates through the two side walls of the second limiting notch and the rocking bar 1, to pivotally connect the third connecting member 7 to the portion of the rocking bar 1 near the first end portion thereof the rocking bar 1; when the rocking chair is unfolded, the second end portion of the first bending section 5 is inclined toward the rear side direction (hereinafter referred to as the "rear side") of the chair, the portion of the rocking bar 1 near the first end portion thereof, is embedded in the second limiting notch and is pushed by the bottom of the second limiting notch, which limits the further unfolding of the rocking chair;

the second supporting bar 8, wherein a portion of the second support bar 8 near the first end portion thereof, is pivotally connected to the fourth connecting member 9 through the fourth pivot shaft; the fourth connecting member 9 includes the second sliding sleeve; the second sliding sleeve is sleeved on the first bending section 5 and is located between the second connecting member 4 and the third connecting member 7; the second sliding sleeve can slide along the first bending section 5; and when the rocking chair is unfolded, the third connecting member 7 converges against the second sliding sleeve, which limits the further unfolding of the rocking chair;

the third supporting bar 10, wherein the fifth connecting member 11 is sleeved on the third supporting bar 10 and is close to the first end portion of the third supporting bar 10; the fifth pivot shaft penetrates through the second supporting bar 8, the third supporting bar 10, and the fifth connecting member 11 to pivotally connect the second supporting bar 8 to the third supporting bar 10 and fix the fifth connecting member 11 to the third supporting bar 10; the fifth pivot shaft is located at a portion of the second supporting bar 8 near the second end portion thereof; a portion of the third supporting bar 10 near the second end portion thereof is pivotally connected to the sixth connecting member 12 through the sixth pivot shaft; the sixth connecting member 12 includes a third sliding sleeve; the third sliding sleeve is sleeved on the first supporting bar 2 and can slide along the first supporting bar 2; the sixth connecting member 12 is located between the first connecting member 3 and the second connecting member 4; the first bending section 5 is pivotally connected to the third supporting bar 10 through a ninth pivot shaft; the ninth pivot shaft on the first bending section 5, is located between the second connecting member 4 and the fourth connecting member 9, and the ninth pivot shaft on the third supporting bar 10 is located between the fifth pivot shaft and the sixth pivot shaft; the first pivot shaft, the second pivot shaft, the third pivot shaft, the fourth pivot shaft, the fifth pivot shaft, the sixth pivot shaft, and the ninth pivot shaft are parallel to each other, and the first pivot shaft is perpendicular to the center plane; and the armrest 13, wherein the seventh connecting member 14 is fixed to a portion of the armrest 13 near the first end portion thereof; the second end portion of the second supporting bar 8 is higher than the fifth pivot shaft by a distance; a portion of the second supporting bar 8 near the second end portion thereof is pivotally connected to the seventh connecting member 14 through the seventh pivot shaft; a portion of the first bending section 5 near the second end portion thereof is pivotally connected to the eighth connecting member 15 through an eighth pivot shaft; the eighth connecting member 15 includes a slider; the bottom of the armrest 13 is provided with a sliding groove extending along the length of the armrest 13; the slider matched with the sliding groove in a sliding manner; the seventh pivot shaft, the eighth pivot shaft, and the first pivot shaft are parallel to each other; the second end portion of the armrest 13 is sealed with a plastic part; and when the chair is unfolded, it is near the second end portion of the armrest 13 and blocked by the plastic part, which limits the further unfolding of the rocking chair.

The folding rocking chair further includes the front cross mechanism and the rear cross mechanism.

The front cross mechanism includes the first front crossbar 16 and the second front crossbar 17 that cross and are pivotally connected by the tenth pivot shaft at the intersection. A portion of the first front crossbar 16 near the first end portion thereof is pivotally connected to the first angle iron through the eleventh pivot shaft. A portion of the second front crossbar 17, near the first end portion thereof, is pivotally connected to the second angle iron through the twelfth pivot shaft. The first angle iron is pivotally connected to the fifth connecting member 11 of one group of folding mechanisms through the thirteenth pivot shaft. The second angle iron is pivotally connected to the fifth connecting member 11 of the other group of the folding mechanisms through the fourteenth pivot shaft. In this embodiment, the thirteenth pivot shaft, the fourteenth pivot shaft, and the fifth pivot shaft are all on the fifth connecting member 11, so the thirteenth pivot shaft is closer to one fifth pivot shaft, and the fourteenth pivot shaft is closer to the other fifth pivot. The thirteenth and fourteenth pivot shafts are perpendicular to the central plane and symmetrical about the central plane. In other embodiments, the thirteenth and fourteenth pivot shafts are respectively the same as the two fifth pivot shafts.

A portion of the first front crossbar 16 near the second end portion thereof is pivotally connected to the third angle iron through the fifteenth pivot shaft. A portion of the second front crossbar 17, near the second end portion thereof, is pivotally connected to the fourth angle iron through the sixteenth pivot shaft. The third angle iron is pivotally connected to the third connecting member 7 of one group of the folding mechanisms through a seventeenth pivot shaft. The fourth angle iron is pivotally connected to the third connecting member 7 of the other group of the folding mechanisms through an eighteenth pivot shaft. The seventeenth and eighteenth pivot shafts are both perpendicular to the center plane and symmetrical about the center plane. The tenth pivot shaft is located in the center plane. The eleventh pivot shaft, the twelfth pivot shaft, the fifteenth pivot shaft, and the sixteenth pivot shaft are all parallel to the tenth pivot shaft.

The rear cross mechanism includes the first rear crossbar 18 and the second rear crossbar 19 that cross and are pivotally connected by the nineteenth pivot shaft at the intersection. A portion of the first rear crossbar 18 near the first end portion thereof is pivotally connected to the fifth angle iron through the twentieth pivot shaft. A portion of the second rear crossbar 19 near the first end portion thereof is pivotally connected to the sixth angle iron through the twenty-first pivot shaft. The fifth angle iron is pivotally connected to the second bending section 6 of one group of the folding mechanisms through the twenty-second pivot shaft. The sixth angle iron is pivotally connected to the second bending section 6 of the other group of the folding mechanisms through the twenty-third pivot shaft. The twenty-second and twenty-third pivot shafts are both perpendicular to the center plane and symmetrical about the center plane.

A portion of the first rear crossbar 18, near a second end portion thereof, is pivotally connected to the seventh angle iron through the twenty-fourth pivot shaft. A portion of the second rear crossbar 19, near the second end portion thereof, is pivotally connected to the eighth angle iron through the twenty-fifth pivot shaft. The seventh angle iron is pivotally connected to the sixth connecting member 12 of one group of the folding mechanisms through a twenty-sixth pivot shaft. The eighth angle iron is pivotally connected to the sixth connecting member 12 of the other group of the folding mechanisms through a twenty-seventh pivot shaft. Both the twenty-sixth pivot shaft and the twenty-seventh pivot shaft are perpendicular to the center plane and symmetrical about the center plane. The nineteenth pivot shaft is located in the center plane. The twentieth pivot shaft, the twenty-first pivot shaft, the twenty-fourth pivot shaft, and the twenty-fifth pivot shaft are all parallel to the nineteenth pivot shaft. The twenty-sixth pivot shaft is the sixth pivot shaft of one group of the folding mechanisms. The twenty-seventh pivot shaft is the sixth pivot shaft of the other group of the folding mechanisms. In some other embodiments, the twenty-sixth pivot shaft and the twenty-seventh pivot shaft are independent pivot shafts that are different from the sixth pivot shafts.

Figure 2:
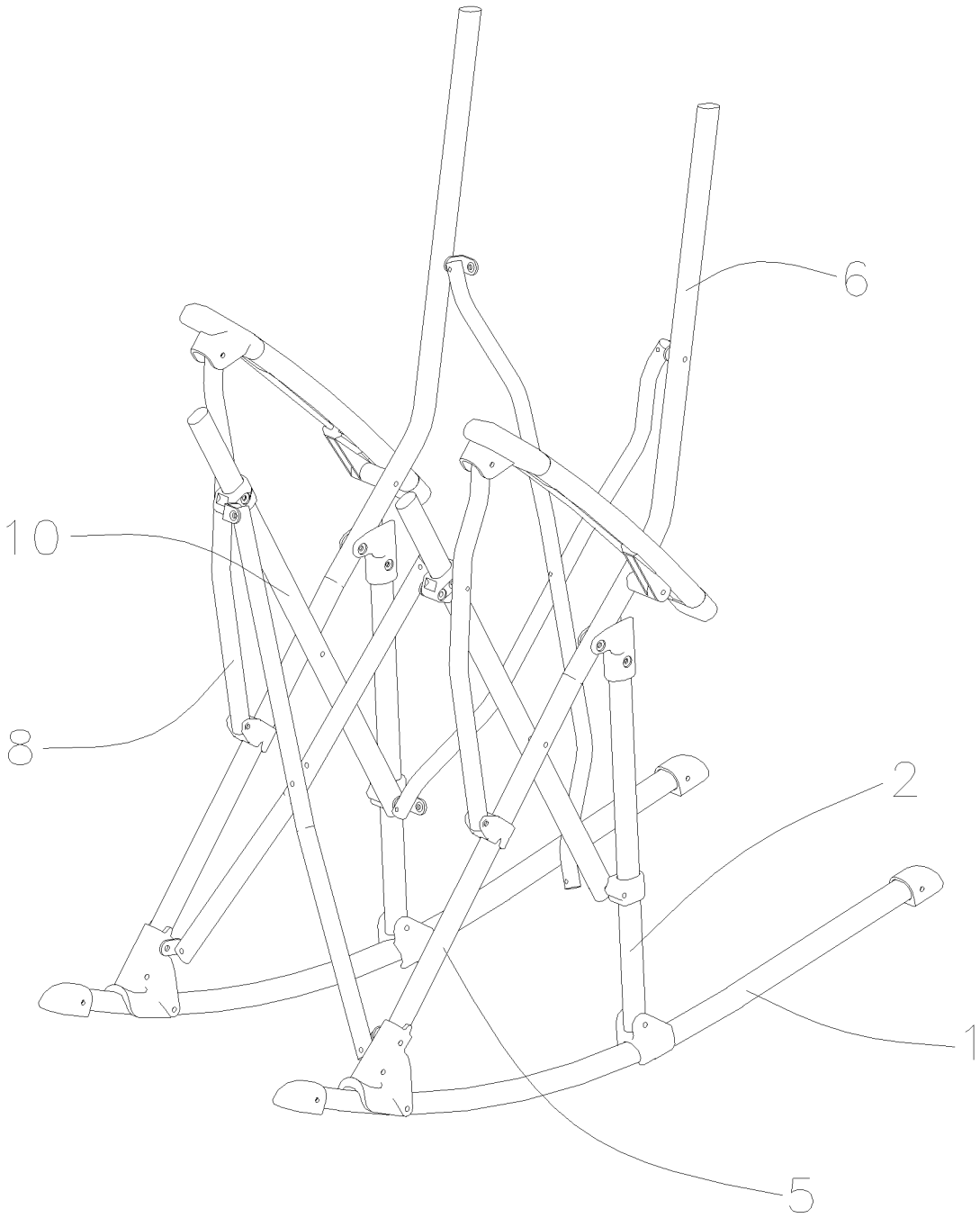
FIG. 2 is a structural schematic diagram of the folding rocking chair in a half-folded state according to embodiment 1 of the present disclosure.
Figure 3:
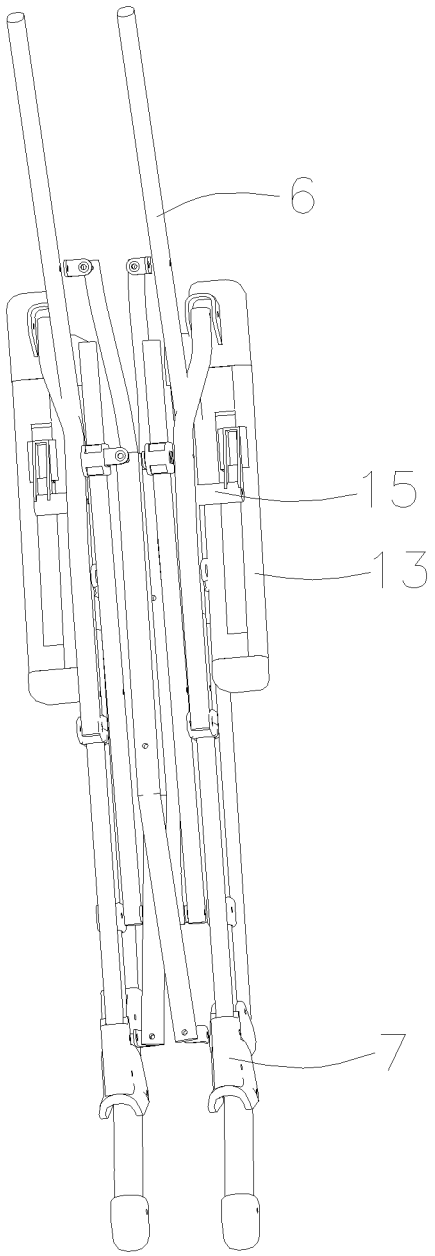
FIG. 3 is a structural schematic diagram of the folding rocking chair in a folded state according to embodiment 1 of the present disclosure.

When the rocking chair is unfolded, the second bending section 6 is slightly inclined toward the rear side, and the first end portion of the third supporting bar 10 is at a certain distance from the fifth connecting member 11. Consequently, a cushioned cloth (not shown in the figures) is hung on the first end portion of the second bending section 6 and the first end portion of the third supporting bar 10 to form a cushion and a backrest. As shown in FIGS. 2-3, when folding the rocking chair, two hands of a user can grasp the first end portion of the third supporting bar and the first end portion of the second bending section 6, respectively. Then, the chair can be folded, with the person folding the chair using some amount of force. When the first connecting member 3 slides to a position close to the third connecting member 7, it is difficult for the user to further fold the rocking chair. At this time, the rocking chair is not compact enough. Since the third connecting member 7 is pivotally connected to the rocking bar 1, the first connecting member 3 is allowed to further approach the third connecting member 7 by lifting the second end portion of the rocking bar 1 in such a way that the rocking chair becomes very compact in a folded state.

Figure 4:
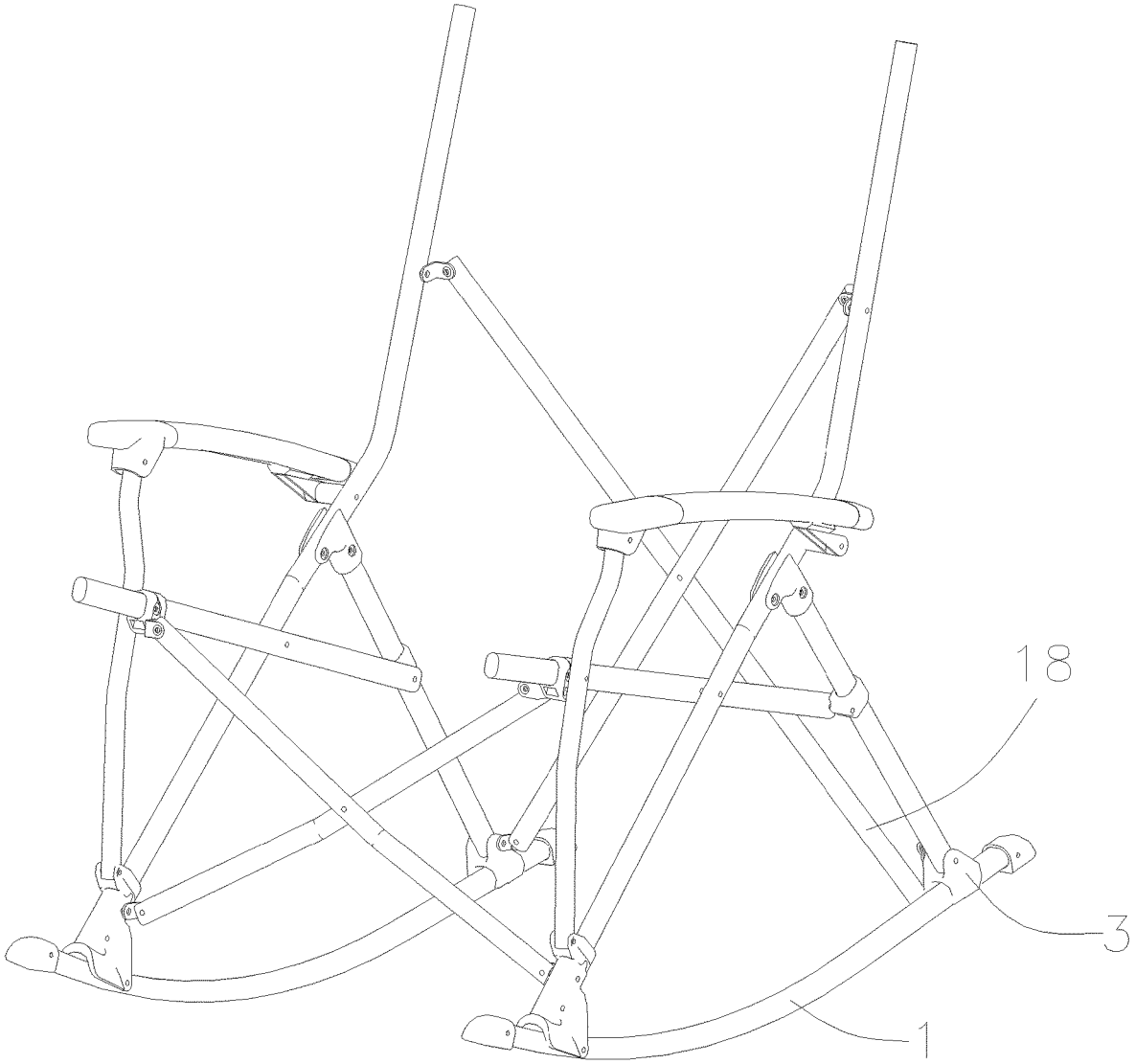
FIG. 4 is a structural schematic diagram of a folding rocking chair in an unfolded state according to embodiment 2 of the present disclosure.
Figure 5:
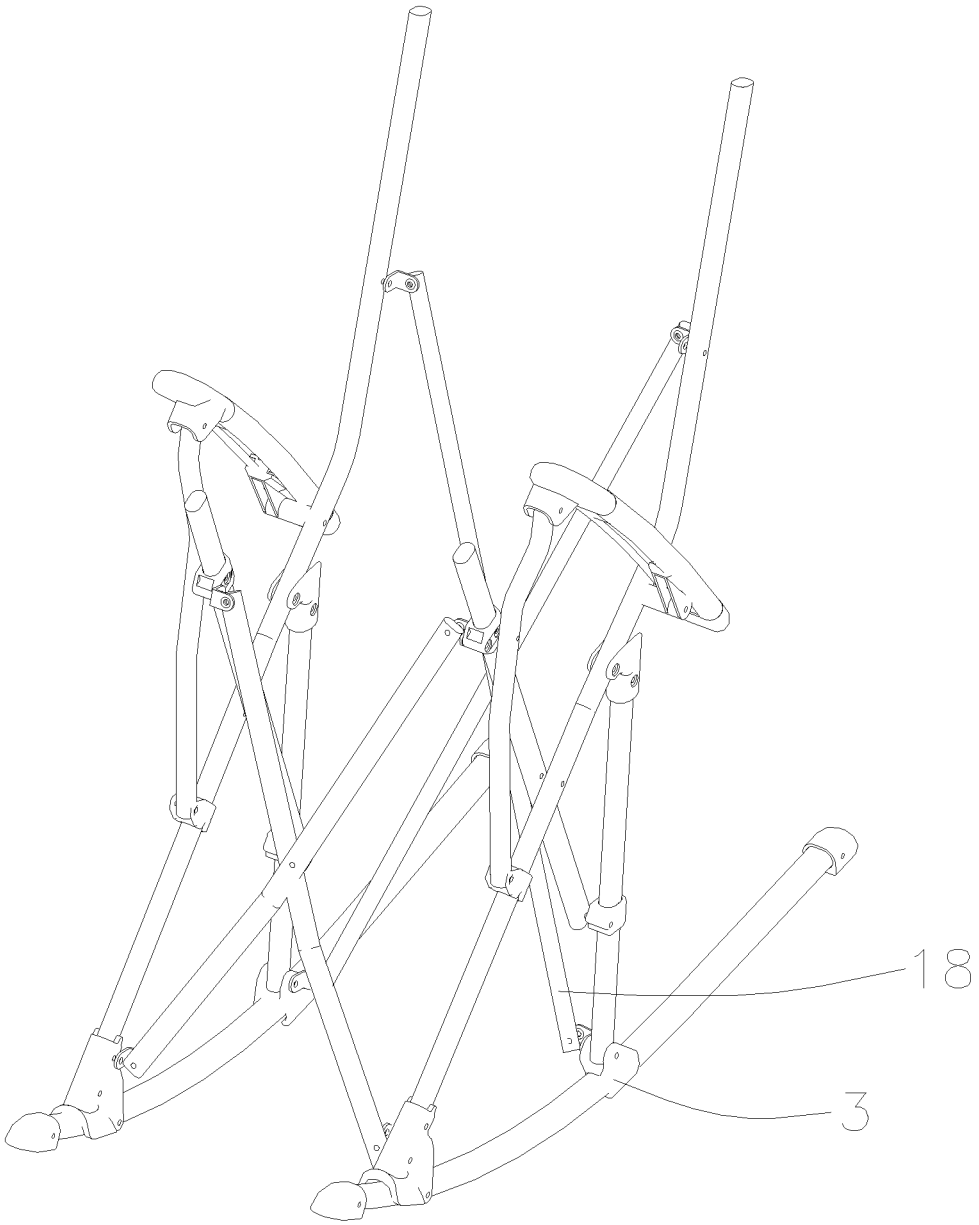
FIG. 5 is a structural schematic diagram of the folding rocking chair in a half-folded state according to embodiment 2 of the present disclosure.

Embodiment 2 of the folding rocking chair is shown in FIGS. 4-5. The structures are the same as embodiment 1 with the exception of the seventh angle iron is pivotally connected to the first connecting member 3 of one group of the folding mechanisms through a twenty-sixth pivot shaft. The eighth angle iron is pivotally connected to the first connecting member 3 of the other group of the folding mechanisms through a twenty-seventh pivot shaft. The twenty-sixth pivot shaft and the twenty-seventh pivot shaft are both perpendicular to the center plane and symmetrical about the center plane. The twenty-sixth pivot shaft is the first pivot shaft of one group of the folding mechanisms, and the twenty-seventh pivot shaft is the first pivot shaft of the other group of the folding mechanisms. In some other embodiments, the twenty-sixth pivot shaft and the twenty-seventh pivot shaft are independent pivot shafts that are different from the first pivot shafts.

Figure 6:
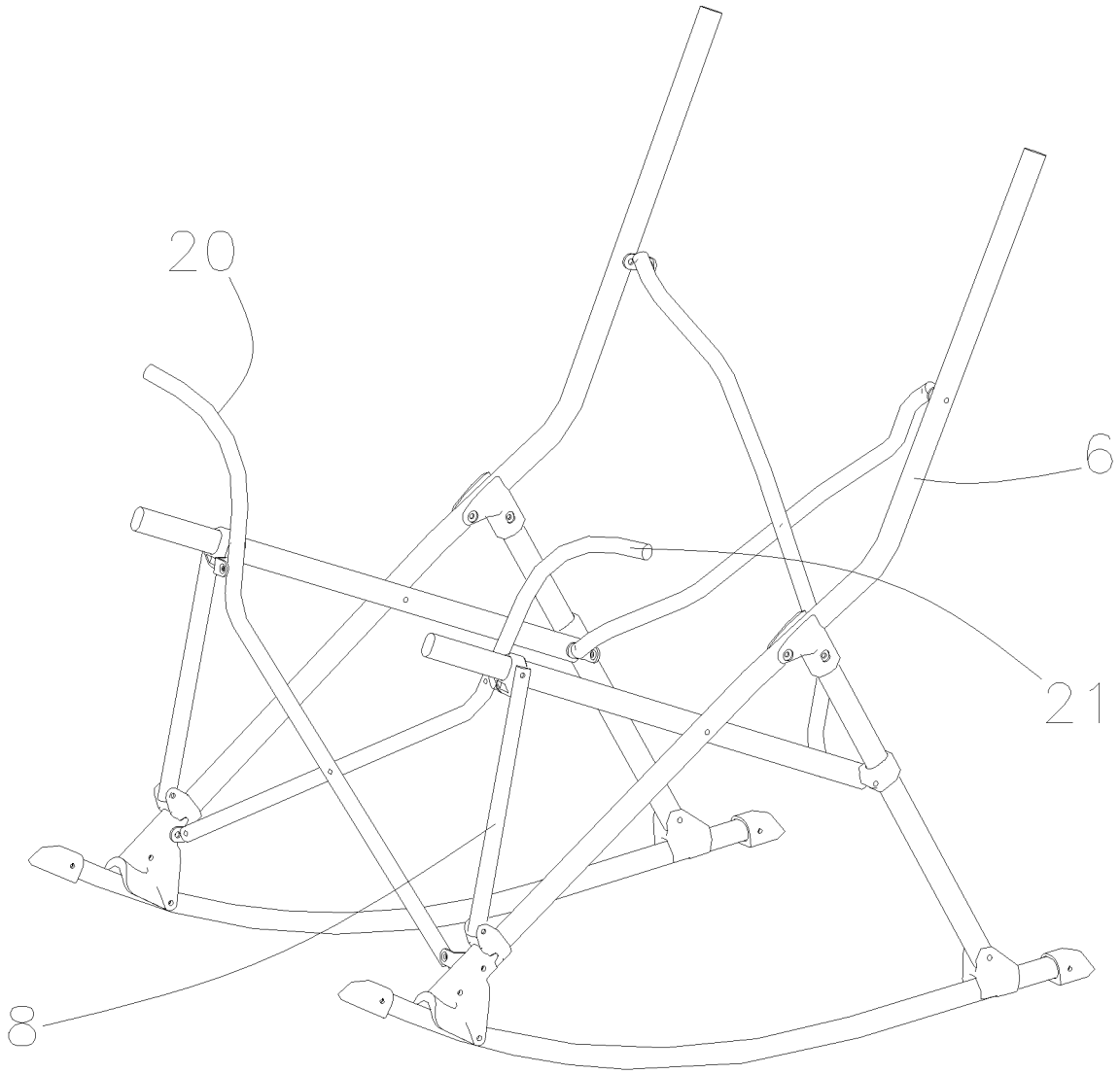
FIG. 6 is a partial structural schematic diagram of a folded rocking chair in an unfolded state according to embodiment 3 of the present disclosure.

As shown in FIG. 6, embodiment 3 is different from embodiment 1 in that the armrest is not connected to the second supporting bar 8. Therefore, the second end portion of the second supporting bar 8 is not higher than the fifth pivot shaft, and the first end portion of the first front crossbar extends to form the first handle 20 for setting the armrest, and the first end of the second front crossbar extends to form the second handle 21 for setting another armrest. The armrests in this embodiment are made of a flexible material such as cloth or plastic. Moreover, one end of one of the armrests is fixed on the first handle 20 and the other end is fixed on the second bending section 6. One end of the other of the armrest is fixed to the second handle 21, and the other end is fixed to another second bending section.

In the description of this specification, the descriptions of the terms "one embodiment", "some embodiments", "examples", "specific examples", "some examples" and the like, refer to specific features, structures, materials or characteristics described in reference with the embodiments, or examples are included in at least one embodiment or example of the present disclosure. In this specification, the schematic expressions of the terms do not necessarily refer to the same embodiment or example. Furthermore, the specific features, structures, materials or characteristics described may be combined with any one or more embodiments or examples in a proper manner.

Taking the above ideal embodiments, according to the present disclosure as inspiration, a person skilled in the art can make various changes and modifications without departing from the technical idea of the present disclosure based on the above description. The technical scope of the present disclosure is not limited to the content in the description, and the technical scope should be determined according to the scope of the claims.

What is claimed is:

1. A folding mechanism, comprising:

a rocking bar, wherein the rocking bar comprises an arc-shaped, ground-contacting portion;

a first supporting bar, wherein a portion of the first supporting bar near a first end portion of the first supporting bar, is pivotally connected to a first connecting member through a first pivot shaft, the first connecting member is connected to the rocking bar and is configured to slide along the rocking bar, and a second connecting member is fixedly connected to a portion of the first supporting bar near a second end portion of the first supporting bar;

a first main bar, wherein the first main bar comprises a first bending section and a second bending section, the first bending section are bent relative to the second bending section, a third connecting member is directly connected to a portion of the first bending section near a first end portion of the first bending section; the third connecting member is pivotally connected to a portion of the rocking bar near the first end portion of the rocking bar, through a third pivot shaft, the first connecting member is located between the second end portion of the rocking bar and the third connecting member, and a portion of the first bending section near a second end portion of the first bending section is pivotally connected to the second connecting member through a second pivot shaft;

a second supporting bar, wherein a portion of the second supporting bar near a first end portion of the second supporting bar, is pivotally connected to a fourth connecting member through a fourth pivot shaft, the fourth connecting member is connected to the first bending section and is configured to slide along the first bending section, and the fourth connecting member is located between the second connecting member and the third connecting member; and a third supporting bar, wherein a portion of the third supporting bar near a first end portion of the third supporting bar, is pivotally connected to a portion of the second support bar near a second end portion of the second support bar through a fifth pivot shaft, a portion of the third supporting bar near a second end portion of the third supporting bar is pivotally connected to a sixth connecting member through a sixth pivot shaft, the sixth connecting member is connected to the first supporting bar and is configured to slide along the first supporting bar, the sixth connecting member is located between the first connecting member and the second connecting member, the first bending section is pivotally connected to the third supporting bar through a ninth pivot shaft, the ninth pivot shaft on the first bending section is located between the second connecting member and the fourth connecting member, the ninth pivot shaft on the third supporting bar is located between the fifth pivot shaft and the sixth connecting member; the first pivot shaft, the second pivot shaft, the third pivot shaft, the fourth pivot shaft, the fifth pivot shaft, the sixth pivot shaft, and the ninth pivot shaft are parallel to each other.

2. The folding mechanism of claim 1, further comprising an armrest, wherein, a seventh connecting member is fixed to a portion of the armrest near a first end portion of the armrest, and a portion of the second supporting bar near a second end portion of the second supporting bar is pivotally connected to the seventh connecting member through a seventh pivot shaft; a portion of the first bending section near a second end portion of the first bending section is pivotally connected to an eighth connecting member through an eighth pivot shaft, and the eighth connecting member is connected to the armrest and is configured to slide along the armrest; the seventh pivot shaft, the eighth pivot shaft, and the first pivot shaft are parallel to each other.

3. The folding mechanism of claim 2, wherein, the armrest is provided with a sliding groove, the eighth connecting member comprises a slider, and the slider is matched with the sliding groove in a sliding manner.

4. The folding mechanism of claim 3, wherein the ground-contacting portion has an arc surface formed by a plurality of continuous straight lines parallel to each other along the length direction of the rocking bar.

5. The folding mechanism of claim 1, wherein the first connecting member comprises a first sliding sleeve, the first sliding sleeve is provided on the rocking bar in a sliding manner, the fourth connecting member comprises a second sliding sleeve, and the second sliding sleeve is provided on the first bending section in a sliding manner.

6. The folding mechanism of claim 1, wherein, the second connecting member comprises a first limiting portion having a first limiting notch, and the second pivot shaft penetrates through two side walls of the first limiting notch and the first bending section; when the folding mechanism is unfolded, the first bending section is embedded in the first limiting notch and is supported by a bottom of the first limiting notch.

7. The folding mechanism of claim 1, wherein, the third connecting member comprises a second limiting portion having a second limiting notch, and the third pivot shaft penetrates through two side walls of the second limiting notch and the rocking bar; when the folding mechanism is unfolded, the rocking bar is embedded in the second limiting notch and is pushed by a bottom of the second limiting notch.

8. A folding rocking chair, comprising two groups of folding mechanisms of claim 1, wherein, the two groups of the folding mechanisms are symmetrical about a center plane;

the folding rocking chair comprises a front cross mechanism and a rear cross mechanism;

the front cross mechanism comprises a first front crossbar and a second front crossbar, wherein the first front crossbar and the second front crossbar cross and are pivotally connected by a tenth pivot shaft at an intersection; a portion of the first front crossbar near a first end portion of the first front crossbar is pivotally connected to a first angle iron through an eleventh pivot shaft; a portion of the second front crossbar near a first end portion of the second front crossbar is pivotally connected to a second angle iron through a twelfth pivot shaft; the first angle iron is pivotally connected to the third supporting bar of a first group of the folding mechanisms through a thirteenth pivot shaft; the second angle iron is pivotally connected to the third supporting bar of a second group of the folding mechanisms through a fourteenth pivot shaft; the thirteenth pivot shaft is located near the fifth pivot shaft of the first group of the folding mechanisms and the fourteenth pivot shaft is located near the fifth pivot shaft of the second group of the folding mechanisms, or the thirteenth pivot shaft is identical with the fifth pivot shaft of the first group of the folding mechanisms and the fourteenth pivot shaft is identical with the fifth pivot shaft of the second group of the folding mechanisms; and the thirteenth pivot shaft and the fourteenth pivot shaft are symmetrical about the center plane;

a portion of the first front crossbar near a second end portion of the first front crossbar is pivotally connected to a third angle iron through a fifteenth pivot shaft; a portion of the second front crossbar near a second end portion of the second front crossbar is pivotally connected to a fourth angle iron through a sixteenth pivot shaft; the third angle iron is pivotally connected to the third connecting member of the first group of the folding mechanisms through a seventeenth pivot shaft; the fourth angle iron is pivotally connected to the third connecting member of the second group of the folding mechanisms through an eighteenth pivot shaft; the seventeenth pivot shaft and the eighteenth pivot shaft are symmetrical about the center plane;

the tenth pivot shaft is located in the center plane, and the eleventh pivot shaft, the twelfth pivot shaft, the fifteenth pivot shaft, and the sixteenth pivot shaft are all parallel to the tenth pivot shaft;

the rear cross mechanism comprises a first rear crossbar and a second rear crossbar, wherein the first rear crossbar and the second rear crossbar cross and are pivotally connected by a nineteenth pivot shaft at an intersection; a portion of the first rear crossbar near a first end portion of the first rear crossbar is pivotally connected to a fifth angle iron through a twentieth pivot shaft; a portion of the second rear crossbar near a first end portion of the second rear crossbar is pivotally connected to a sixth angle iron through a twenty-first pivot shaft; the fifth angle iron is pivotally connected to the second bending section of the first group of the folding mechanisms through a twenty-second pivot shaft; the sixth angle iron is pivotally connected to the second bending section of the second group of the folding mechanisms through a twenty-third pivot shaft; the twenty-second pivot shaft and the twenty-third pivot shaft are symmetrical about the center plane;

a portion of the first rear crossbar near a second end portion of the first rear crossbar is pivotally connected to a seventh angle iron through a twenty-fourth pivot shaft; a portion of the second rear crossbar near a second end portion of the second rear crossbar is pivotally connected to an eighth angle iron through a twenty-fifth pivot shaft; the seventh angle iron is pivotally connected to the sixth connecting member of the first group of the folding mechanisms through a twenty-sixth pivot shaft; the eighth angle iron is pivotally connected to the sixth connecting member of the second group of the folding mechanisms through a twenty-seventh pivot shaft; the twenty-sixth pivot shaft and the twenty-seventh pivot shaft are symmetrical about the center plane; and the nineteenth pivot shaft is located in the center plane; and the twentieth pivot shaft, the twenty-first pivot shaft, the twenty-fourth pivot shaft, and the twenty-fifth pivot shaft are all parallel to the nineteenth pivot shaft.

9. The folding rocking chair of claim 8, wherein each of the folding mechanisms comprises an armrest, a seventh connecting member is fixed to a portion of the armrest near a first end portion of the armrest, and a portion of the second supporting bar near a second end portion of the second supporting bar is pivotally connected to the seventh connecting member through a seventh pivot shaft; a portion of the first bending section near a second end portion of the first bending section is pivotally connected to an eighth connecting member through an eighth pivot shaft, and the eighth connecting member is connected to the armrest and is configured to slide along the armrest; the seventh pivot shaft, the eighth pivot shaft, and the first pivot shaft are parallel to each other.

10. The folding rocking chair of claim 9, wherein, the armrest is provided with a sliding groove, the eighth connecting member comprises a slider, and the slider is matched with the sliding groove in a sliding manner.

11. The folding rocking chair of claim 10, wherein the ground-contacting portion has an arc surface formed by a plurality of continuous straight lines parallel to each other along the length direction of the rocking bar.

12. The folding rocking chair of claim 8, wherein, the twenty-sixth pivot shaft is the sixth pivot shaft of the first group of the folding mechanisms, and the twenty-seventh pivot shaft is the sixth pivot shaft of the second group of the folding mechanisms; and each of the folding mechanisms further comprises a fifth connecting member; the fifth connecting member is sleeved on the third supporting bar; the fifth pivot shaft penetrates through the second supporting bar, the third supporting bar, and the fifth connecting member; the first angle iron is pivotally connected to the fifth connecting member of the first group of the folding mechanisms through the thirteenth pivot shaft, and the second angle iron is pivotally connected to the fifth connecting member of the second group of the folding mechanisms through the fourteenth pivot shaft.

13. The folding rocking chair of claim 8, wherein, the first end portion of the first front crossbar extends to form a first handle for setting the armrest of the first group of the folding mechanisms, and the first end portion of the second front crossbar extends to form a second handle for setting the armrest of the second group of the folding mechanisms.

14. A folding rocking chair, comprising two groups of folding mechanisms of claim 1, wherein, the two groups of the folding mechanisms are symmetrical about a center plane;

the folding rocking chair comprises a front cross mechanism and a rear cross mechanism;

the front cross mechanism comprises a first front crossbar and a second front crossbar, wherein the first front crossbar and the second front crossbar cross and are pivotally connected by a tenth pivot shaft at an intersection; a portion of the first front crossbar near a first end portion of the first front crossbar is pivotally connected to a first angle iron through an eleventh pivot shaft; a portion of the second front crossbar near a first end portion of the second front crossbar is pivotally connected to a second angle iron through a twelfth pivot shaft; the first angle iron is pivotally connected to the third supporting bar of a first group of the folding mechanisms through a thirteenth pivot shaft; the second angle iron is pivotally connected to the third supporting bar of a second group of the folding mechanisms through a fourteenth pivot shaft; the thirteenth pivot shaft is located near the fifth pivot shaft of the first group of the folding mechanisms and the fourteenth pivot shaft is located near the fifth pivot shaft of the second group of the folding mechanisms, or the thirteenth pivot shaft is identical with the fifth pivot shaft of the first group of the folding mechanisms and the fourteenth pivot shaft is identical with the fifth pivot shaft of the second group of the folding mechanisms; the thirteenth pivot shaft and the fourteenth pivot shaft are symmetrical about the center plane;

a portion of the first front crossbar near a second end portion of the first front crossbar is pivotally connected to a third angle iron through a fifteenth pivot shaft; a portion of the second front crossbar near a second end portion of the second front crossbar is pivotally connected to a fourth angle iron through a sixteenth pivot shaft; the third angle iron is pivotally connected to the third connecting member of the first group of the folding mechanisms through a seventeenth pivot shaft; the fourth angle iron is pivotally connected to the third connecting member of the second group of the folding mechanisms through an eighteenth pivot shaft; the seventeenth pivot shaft and the eighteenth pivot shaft are symmetrical about the center plane;

the tenth pivot shaft is located in the center plane, and the eleventh pivot shaft, the twelfth pivot shaft, the fifteenth pivot shaft, and the sixteenth pivot shaft are all parallel to the tenth pivot shaft;

the rear cross mechanism comprises a first rear crossbar and a second rear crossbar, wherein the first rear crossbar and the second rear crossbar cross and are pivotally connected by a nineteenth pivot shaft at an intersection; a portion of the first rear crossbar near a first end portion of the first rear crossbar is pivotally connected to a fifth angle iron through a twentieth pivot shaft; a portion of the second rear crossbar near a first end portion of the second rear crossbar is pivotally connected to a sixth angle iron through a twenty-first pivot shaft; the fifth angle iron is pivotally connected to the second bending section of the first group of the folding mechanisms through a twenty-second pivot shaft; the sixth angle iron is pivotally connected to the second bending section of the second group of the folding mechanisms through a twenty-third pivot shaft; the twenty-second pivot shaft and the twenty-third pivot shaft are symmetrical about the center plane;

a portion of the first rear crossbar near a second end portion of the first rear crossbar is pivotally connected to a seventh angle iron through a twenty-fourth pivot shaft; a portion of the second rear crossbar near a second end portion of the second rear crossbar is pivotally connected to an eighth angle iron through a twenty-fifth pivot shaft; the seventh angle iron is pivotally connected to the first connecting member of the first group of the folding mechanisms through a twenty-sixth pivot shaft; the eighth angle iron is pivotally connected to the first connecting member of the second group of the folding mechanisms through a twenty-seventh pivot shaft; the twenty-sixth pivot shaft and the twenty-seventh pivot shaft are symmetrical about the center plane; and the nineteenth pivot shaft is located in the center plane; and the twentieth pivot shaft, the twenty-first pivot shaft, the twenty-fourth pivot shaft, and the twenty-fifth pivot shaft are all parallel to the nineteenth pivot shaft.

15. The folding rocking chair of claim 14, wherein each of the folding mechanisms comprises an armrest, a seventh connecting member is fixed to a portion of the armrest near a first end portion of the armrest, and a portion of the second supporting bar near a second end portion of the second supporting bar is pivotally connected to the seventh connecting member through a seventh pivot shaft; a portion of the first bending section near a second end portion of the first bending section is pivotally connected to an eighth connecting member through an eighth pivot shaft, and the eighth connecting member is connected to the armrest and is configured to slide along the armrest; the seventh pivot shaft, the eighth pivot shaft, and the first pivot shaft are parallel to each other.

16. The folding rocking chair of claim 15, wherein, the armrest is provided with a sliding groove, the eighth connecting member comprises a slider, and the slider is matched with the sliding groove in a sliding manner.

17. The folding rocking chair of claim 16, wherein, the ground-contacting portion is an arc surface formed by a plurality of straight lines parallel to each other along the length direction of the rocking bar.

18. The folding rocking chair of claim 14, wherein, the twenty-sixth pivot shaft is the first pivot shaft of the first group of the folding mechanisms, and the twenty-seventh pivot shaft is the first pivot shaft of the second group of the folding mechanisms; and each of the folding mechanisms further comprises a fifth connecting member; the fifth connecting member is sleeved on the third supporting bar; the fifth pivot shaft penetrates through the second supporting bar, the third supporting bar, and the fifth connecting member; the first angle iron is pivotally connected to the fifth connecting member of the first group of the folding mechanisms through the thirteenth pivot shaft; the second angle iron is pivotally connected to the fifth connecting member of the second group of the folding mechanisms through the fourteenth pivot shaft.

19. The folding rocking chair of claim 14, wherein, the first end portion of the first front crossbar extends to form a first handle for setting the armrest of the first group of the folding mechanisms, and the first end portion of the second front crossbar extends to form a second handle for setting the armrest of the second group of the folding mechanisms.

* * * * *